US012433461B2

(12) United States Patent
Innes et al.

(10) Patent No.: US 12,433,461 B2
(45) Date of Patent: Oct. 7, 2025

(54) VACUUM CLEANER

(71) Applicant: SHARKNINJA OPERATING LLC, Needham, MA (US)

(72) Inventors: Daniel J. Innes, Bedfordshire (GB); Nikola Petrov, Boston, MA (US); Steven Gacin, Pawtucket, RI (US)

(73) Assignee: SharkNinja Operating LLC, Needham, MA (US)

( * ) Notice: Subject to any disclaimer, the term of this patent is extended or adjusted under 35 U.S.C. 154(b) by 407 days.

(21) Appl. No.: 17/857,639

(22) Filed: Jul. 5, 2022

(65) Prior Publication Data

US 2024/0008699 A1 Jan. 11, 2024

(51) Int. Cl.

| | |
|---|---|
| ***A47L 9/14*** | (2006.01) |
| ***A47L 9/00*** | (2006.01) |
| ***A47L 9/28*** | (2006.01) |

(52) U.S. Cl.

CPC ..... *A47L 9/149* (2013.01); *A47L 9/0063* (2013.01); *A47L 9/1409* (2013.01); *A47L 9/2873* (2013.01)

(58) Field of Classification Search

CPC ..... A47L 9/149; A47L 9/0063; A47L 9/1409; A47L 9/2873; A47L 5/26

USPC ..... 15/339

See application file for complete search history.

(56) References Cited

U.S. PATENT DOCUMENTS

| | | | |
|---|---|---|---|
| 7,958,597 | B2 | 6/2011 | Frantzen et al. |
| 8,225,456 | B2 | 7/2012 | Håkan et al. |
| 9,060,666 | B2 | 6/2015 | Jang et al. |
| 9,826,871 | B2 | 11/2017 | Jang et al. |
| 10,194,779 | B2 | 2/2019 | Kim et al. |
| 10,299,650 | B2 | 5/2019 | Kim et al. |
| 10,299,651 | B2 | 5/2019 | Kim et al. |
| 10,314,453 | B2 | 6/2019 | Kim et al. |

(Continued)

FOREIGN PATENT DOCUMENTS

| | | | |
|---|---|---|---|
| AU | 2017262306 | B2 | 3/2020 |
| AU | 2021204750 | A1 | 8/2021 |

(Continued)

OTHER PUBLICATIONS

Chinese Office Action with machine-generated translation issued Dec. 14, 2023, received in Chinese Patent Application No. 202321757693.X, 5 pages.

(Continued)

*Primary Examiner* — Katina N. Henson

(74) *Attorney, Agent, or Firm* — Grossman Tucker Perreault & Pfleger, PLLC

(57) ABSTRACT

A cleaning system may include a vacuum cleaner having a body and a cleaner dust cup coupled to the body and a docking station, the vacuum cleaner configured to dock with the docking station. The cleaner dust cup may include an open end that is configured to be selectively received within the body and a dust cup outlet that is configured to be selectively opened and closed, the dust cup outlet and the open end being on different sides of the cleaner dust cup. The docking station may include a base having a suction motor and a station dust cup, an up-duct extending from the base, and a receptacle having a station inlet, the receptacle being configured to receive at least a portion of the vacuum cleaner, the up-duct fluidly couples the station inlet to the suction motor and the station dust cup.

20 Claims, 8 Drawing Sheets

(56) References Cited

U.S. PATENT DOCUMENTS 10,342,404 B2 7/2019 Kim et al.
10,405,717 B2 9/2019 Kim et al.
10,405,719 B2 9/2019 Kim et al.
10,561,291 B2 2/2020 Kim et al.
10,610,075 B2 4/2020 Kim et al.
10,660,493 B2 5/2020 Kim et al.
10,959,589 B2 3/2021 Kim et al.
10,973,380 B2 4/2021 Seo et al.
11,006,797 B1 5/2021 Cho et al.
11,134,817 B2 10/2021 Kim et al.
11,134,818 B2 10/2021 Kim et al.
11,229,339 B2 1/2022 Cho et al.
11,337,573 B2 5/2022 Kim et al.
11,357,374 B2 6/2022 Cho et al.
11,363,928 B2 6/2022 Kim et al.
11,382,471 B2 7/2022 Kim et al.
11,382,472 B2 7/2022 Kim et al.
11,399,676 B2 8/2022 Kim et al.
11,452,417 B2 9/2022 Na et al.
11,484,166 B2 11/2022 Seo et al.
11,484,168 B2 11/2022 Cho et al.
11,497,365 B2 11/2022 Cho et al.
11,503,969 B2 11/2022 Cho et al.
11,839,348 B2 12/2023 Kim et al.
11,864,718 B2 1/2024 Cho et al.
11,903,552 B2 2/2024 Cho et al.
11,957,297 B2 4/2024 Cho et al.
12,004,703 B2 6/2024 Kim et al.
2013/0058635 A1 3/2013 Vrdoljak
2013/0152337 A1 6/2013 Thorne
2014/0137363 A1* 5/2014 Wilson ..... A47L 9/1625 15/347
2014/0150201 A1 6/2014 McGee et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne
2016/0128530 A1 5/2016 Thorne et al.
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0280950 A1 10/2017 Nam et al.
2017/0347848 A1 12/2017 Carter et al.
2018/0035854 A1 2/2018 Thorne
2018/0055320 A1 3/2018 Hwang et al.
2018/0064301 A1 3/2018 Cottrell et al.
2018/0068815 A1 3/2018 Cottrell
2018/0070785 A1 3/2018 Udy et al.
2018/0125314 A1* 5/2018 Kim ..... A47L 9/0027
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1* 3/2019 Tonderys ..... A47L 9/02
2019/0090705 A1 3/2019 Thorne et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320861 A1 10/2019 Conrad
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0029760 A1 1/2020 Seo et al.
2020/0037833 A1 2/2020 Niedzwecki et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1* 11/2020 Innes ..... A47L 9/1683
2020/0367711 A1 11/2020 Thorne et al.
2020/0371526 A1 11/2020 Kamada
2020/0383547 A1 12/2020 Sutter et al.
2021/0000315 A1 1/2021 Na et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0052121 A1 2/2021 Kim et al.
2021/0059495 A1 3/2021 Gill et al.
2021/0068603 A1 3/2021 Cho et al.
2021/0085144 A1 3/2021 Woodrow et al.
2021/0145231 A1 5/2021 Conrad
2021/0169289 A1 6/2021 Thorne et al.
2021/0175772 A1 6/2021 Aini
2021/0177223 A1 6/2021 Der Marderosian et al.
2021/0177225 A1 6/2021 Kim et al.
2021/0186282 A1 6/2021 Mathieu et al.
2021/0204684 A1 7/2021 Heman-Ackah et al.
2021/0254615 A1 8/2021 Burbank
2021/0259487 A1 8/2021 Cho et al.
2021/0259490 A1 8/2021 Kim et al.
2021/0282610 A1 9/2021 Cho et al.
2021/0290017 A1 9/2021 Kim et al.
2021/0307581 A1 10/2021 Thorne et al.
2021/0315428 A1 10/2021 Udy et al.
2021/0386261 A1 12/2021 Woodrow et al.
2021/0386262 A1 12/2021 Uchendu et al.
2022/0031131 A1 2/2022 McClay et al.
2022/0031133 A1 2/2022 Der Marderosian et al.
2022/0031134 A1 2/2022 Yang et al.
2022/0061614 A1 3/2022 Yu et al.
2022/0071459 A1 3/2022 Gacin et al.
2022/0095862 A1 3/2022 Kim et al.
2022/0095864 A1 3/2022 Der Marderosian et al.
2022/0095867 A1 3/2022 Cho et al.
2022/0125256 A1 4/2022 Lessard et al.
2022/0183524 A1 6/2022 Kim et al.
2022/0287521 A1 9/2022 Cottrell et al.
2022/0322903 A1 10/2022 Lessard
2022/0400922 A1 12/2022 Mcclay et al.
2022/0408994 A1 12/2022 Hill
2023/0043567 A1 2/2023 Copeland et al.
2023/0056726 A1 2/2023 Na et al.
2023/0070147 A1 3/2023 Harting et al.
2023/0111023 A1 4/2023 Cho et al.

(56) References Cited

U.S. PATENT DOCUMENTS

| | | | | |
|---|---|---|---|---|
| 2023/0146588 | A1* | 5/2023 | Kim | A47L 9/106 15/347 |
| 2023/0157495 | A1 | 5/2023 | Copeland et al. | |
| 2023/0248192 | A1 | 8/2023 | Brown et al. | |
| 2023/0320550 | A1 | 10/2023 | Teuscher et al. | |
| 2023/0329502 | A1 | 10/2023 | Chirikjian | |
| 2023/0355065 | A1 | 11/2023 | Finnegan | |
| 2023/0414052 | A1 | 12/2023 | McClay et al. | |
| 2024/0008699 | A1 | 1/2024 | Innes et al. | |
| 2024/0057834 | A1 | 2/2024 | Kim et al. | |
| 2024/0090723 | A1 | 3/2024 | Cho et al. | |
| 2024/0415352 | A1 | 12/2024 | Mcclay et al. | |

FOREIGN PATENT DOCUMENTS

| | | | |
|---|---|---|---|
| AU | 2020201842 | B2 | 12/2021 |
| AU | 2019314058 | B2 | 6/2022 |
| AU | 2022203685 | A1 | 6/2022 |
| CN | 102525335 | | 7/2012 |
| CN | 207768302 | U | 8/2018 |
| CN | 211130863 | U | 7/2020 |
| CN | 211723007 | | 10/2020 |
| CN | 212853334 | | 4/2021 |
| CN | 213429875 | U | 6/2021 |
| CN | 216135772 | | 3/2022 |
| CN | 216417088 | | 5/2022 |
| CN | 114601367 | | 6/2022 |
| CN | 111867435 | B | 7/2022 |
| CN | 114847796 | A | 8/2022 |
| CN | 217723395 | | 11/2022 |
| CN | 115734735 | | 3/2023 |
| DE | 212019000210 | U | 10/2020 |
| EP | 3769654 | A1 | 1/2021 |
| EP | 3456234 | B1 | 8/2022 |
| JP | 6686177 | B2 | 4/2020 |
| JP | 6880276 | B2 | 6/2021 |
| KR | 101841455 | B1 | 5/2018 |
| KR | 101952658 | B1 | 2/2019 |
| KR | 102101696 | B1 | 5/2020 |
| KR | 20200073975 | A | 6/2020 |
| KR | 102164719 | B1 | 10/2020 |
| KR | 102166773 | B1 | 10/2020 |
| KR | 20210100059 | A | 8/2021 |
| KR | 102295181 | B1 | 9/2021 |
| KR | 102307787 | B1 | 10/2021 |
| KR | 20220051146 | A | 4/2022 |
| KR | 20220111727 | | 8/2022 |
| TW | I709388 | B | 11/2020 |
| TW | I725176 | B | 4/2021 |

OTHER PUBLICATIONS

PCT Search Report and Written Opinion mailed Jan. 3, 2024, received in PCT Application No. PCT/CN23/89389, 10 pages.

PCT Search Report and Written Opinion mailed Sep. 26, 2023, received in PCT Application No. PCT/US2023/026292, 9 pages.

* cited by examiner

VACUUM CLEANER

TECHNICAL FIELD

The present disclosure is generally related to surface treatment devices and more specifically to vacuum cleaners configured to interface with a docking station.

BACKGROUND INFORMATION

Surface treatment devices are configured to remove at least a portion of any debris that is deposited on a surface to be cleaned (e.g., a floor). For example, the surface treatment apparatus may be a vacuum cleaner that includes a suction motor, a suction inlet, and a dust cup. The suction motor is configured to cause air to flow through the suction inlet and into the dust cup. As air is drawn into the suction inlet at least a portion of any debris on the surface to be cleaned may become entrained within the air. At least a portion of the entrained debris may be deposited within the dust cup for later disposal by a user of the vacuum cleaner. Frequency of disposal may be based, at least in part, on a volume of the dust cup. Increased dust cup volumes may result in increased overall weight and/or size of the vacuum cleaner. While smaller dust cup volumes may reduce a weight and/or size of the vacuum cleaner, it may result in more frequent disposal of debris, which may expose the user more frequently to the disposed debris.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a vacuum cleaner and a docking station configured to interface with the vacuum cleaner. The vacuum cleaner includes a cleaner suction motor, a cleaner suction inlet, and a cleaner dust cup. The cleaner suction motor is fluidly coupled to the cleaner suction inlet and the cleaner dust cup such that cleaner suction motor, when activated, draws air through cleaner suction inlet and into the cleaner dust cup. Air drawn through the cleaner suction inlet may have debris entrained therein. At least a portion of the entrained debris is deposited within the cleaner dust cup for later disposal. The cleaner dust cup can include a first emptying configuration and a second emptying configuration for removing debris from the cleaner dust cup. The first emptying configuration can correspond to a manual emptying configuration (e.g., for emptying the cleaner dust cup into a trash receptacle by a user) and the second emptying configuration can correspond to an automated emptying configuration (e.g., for emptying the cleaner dust cup using the docking station).

The docking station includes a station suction motor, a receptacle having a station suction inlet, and a station dust cup. The station suction motor is configured to cause air to flow into the station suction inlet and through the station dust cup. The receptacle is configured to interface with the vacuum cleaner such that vacuum cleaner removably couples to (docks with) the docking station. The cleaner dust cup can be transitioned to the automated emptying configuration when the vacuum cleaner is docked to the docking station and the station suction motor is activated. When in the automated emptying configuration, the cleaner dust cup and the station dust cup are fluidly coupled such that, when the station suction motor is activated, at least of portion of any debris stored within the cleaner dust cup is transferred into the station dust cup.

Use of the docking station to empty the cleaner dust cup may reduce a number times a user is exposed to debris collected by the vacuum cleaner (e.g., as a result of debris pluming during emptying). For example, the station dust cup may be configured to have a volume that is greater than the cleaner dust cup (e.g., a volume that is at least two times greater). As such, a user may dispose of collected debris less frequently, reducing exposure of the user to debris.

Figure 1:
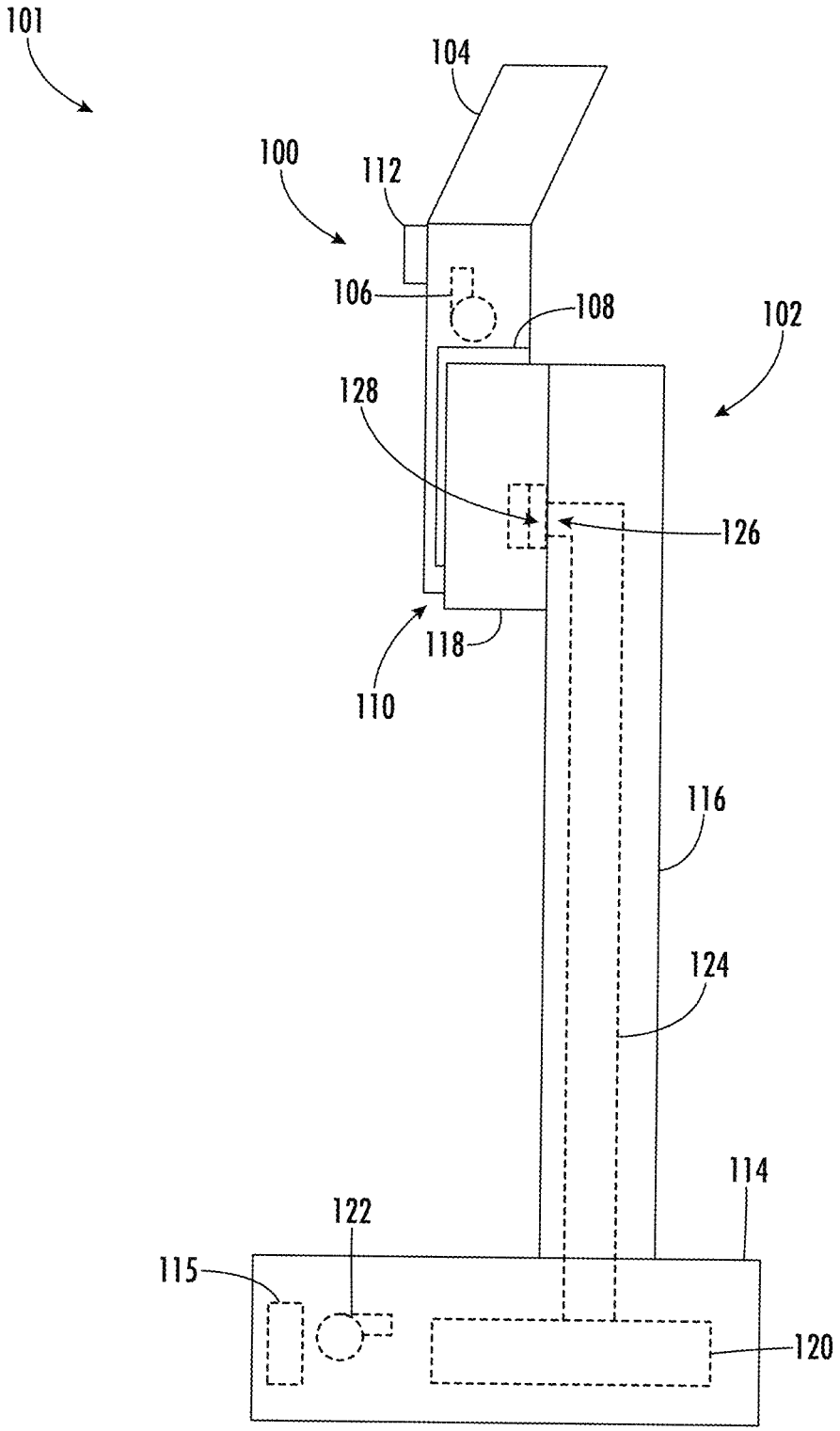
FIG. 1 is a schematic example of a vacuum cleaner docked with a docking station, consistent with embodiments of the present disclosure.

FIG. 1 shows a schematic example of a cleaning system 101 having a vacuum cleaner 100 removably coupled (docked) to a docking station 102. The vacuum cleaner 100 includes a handle 104, a cleaner suction motor 106, a cleaner dust cup 108, and a cleaner inlet 110. The cleaner suction motor 106 is fluidly coupled to the cleaner inlet 110 and the cleaner dust cup 108 such that, when the cleaner suction motor 106 is activated, air is caused to flow through the cleaner inlet 110 and into the cleaner dust cup 108. Air flowing through the cleaner inlet 110 may have debris entrained therein. At least a portion of the entrained debris may be deposited in the cleaner dust cup 108 for later disposal. The cleaner dust cup 108 can be configured to have a first emptying configuration and a second emptying configuration, wherein the cleaner dust cup 108 can be in the first emptying configuration when the vacuum cleaner 100 is undocked from the docking station 102 and can be in the second emptying configuration when the vacuum cleaner 100 is docked with the docking station 102. As such, the first emptying configuration may generally be referred to as a manual emptying configuration and the second emptying configuration may be generally referred to as an automated emptying configuration.

A user interface 112 can be disposed on and/or proximate to the handle 104 (e.g., within 10%, 15%, 20%, 25%, 35% or 50% of a maximum dimension of the handle 104). The user interface 112 may include one or more of a start toggle (e.g., for starting the suction motor 106), a cleaning behavior toggle (e.g., for increasing a suction power of the suction motor 106), a dust cup empty toggle (e.g., to transition the cleaner dust cup 108 to the manual emptying configuration), and/or any other toggle.

The docking station 102 includes a base 114, an up-duct 116 extending from the base 114, and receptacle 118 coupled to the up-duct 116. The receptacle 118 is configured to receive at least a portion of the vacuum cleaner 100. The base 114 includes a station dust cup 120 and a station suction motor 122. In some instances, the base 114 may also include a post motor filter 115, wherein exhaust from the station suction motor 122 is configured to pass through the post motor filter 115. The post motor filter 115 may be a high efficiency particulate air ("HEPA") filter (e.g., a pleated HEPA filter).

The up-duct 116 includes an air channel 124 that is fluidly coupled to the station dust cup 120 and the station suction motor 122 such that the station suction motor 122, when activated, causes air to be drawn through the air channel 124 and into the station dust cup 120. The receptacle 118 includes a station inlet 126 that is fluidly coupled to the air channel 124 such that, when activated, the station suction motor 122 causes air to be drawn through the station inlet 126 and into the air channel 124. In other words, the up-duct 116 fluidly couples the station inlet 126 to the station suction motor 122 and the station dust cup 120.

As shown, the cleaner dust cup 108 includes a dust cup outlet 128 configured to fluidly couple to the station inlet 126 when the vacuum cleaner 100 is docked with the docking station 102 (e.g., when at least a portion of the vacuum cleaner 100 is received within the receptacle 118). When the station suction motor 122 activated air is caused to be drawn through the dust cup outlet 128 and into the station inlet 126. The dust cup outlet 128 may be configured to be selectively opened and closed when the vacuum cleaner 100 is docked to the docking station 102. When the dust cup outlet 128 is in the open configuration, the cleaner dust cup 108 is in the automated emptying configuration.

Figure 2:
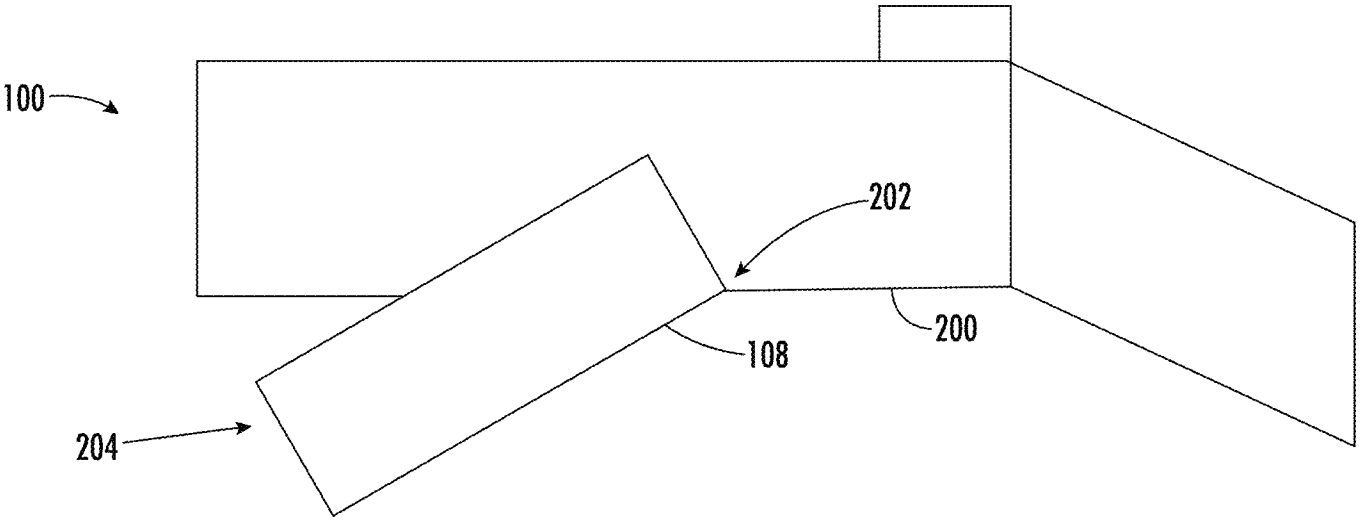
FIG. 2 is a schematic example of the vacuum cleaner of FIG. 1 having a dust cup in a manual emptying configuration, consistent with embodiments of the present disclosure.

FIG. 2 shows a schematic example of the vacuum cleaner 100 having the cleaner dust cup 108 in the manual emptying configuration. As shown, the cleaner dust cup 108 is coupled (e.g., moveably coupled, removably coupled, and/or pivotally coupled) to a body 200 of the vacuum cleaner 100 such that the cleaner dust cup 108 is able to transition between a stowed configuration and the manual emptying configuration. For example, and as shown, the cleaner dust cup 108 can be pivotally coupled to the body 200 of the vacuum cleaner 100 at a pivot point 202 such that the cleaner dust cup 108 pivots from the stowed configuration to the manual emptying configuration. When in the manual emptying configuration, debris within the cleaner dust cup 108 may be emptied from a dust cup open end 204 of the cleaner dust cup 108. The dust cup open end 204 may be opposite the pivot point 202 of the cleaner dust cup 108. Such a configuration may encourage debris to be emptied from the dust cup open end 204 as a result of the pivotal movement of the cleaner dust cup 108.

Figure 3:
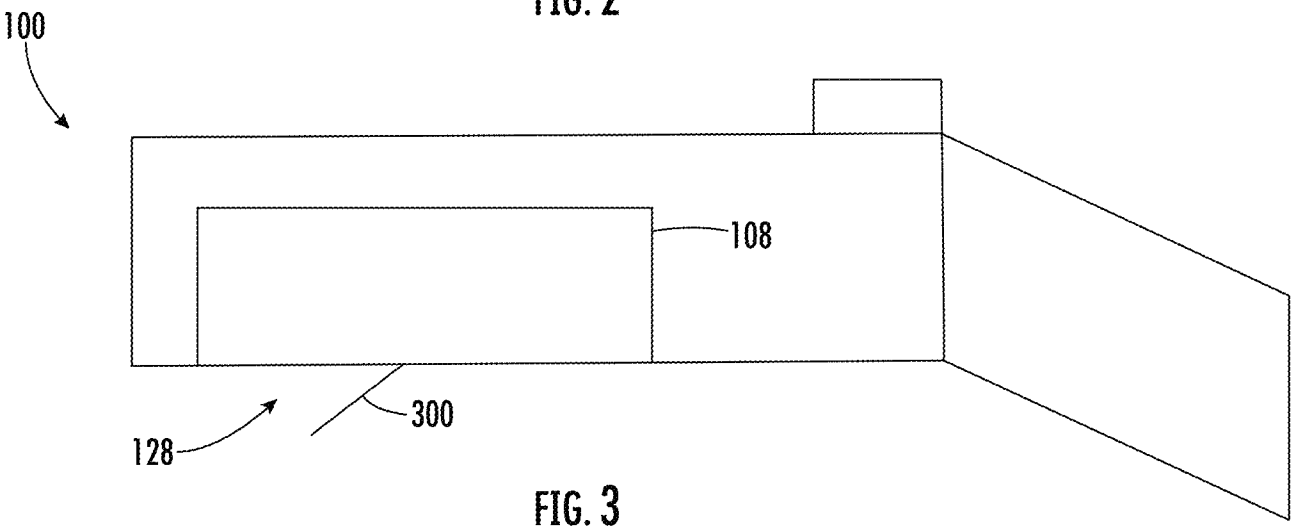
FIG. 3 is a schematic example of the vacuum cleaner of FIG. 1 having the dust cup in an automated emptying configuration, consistent with embodiments of the present disclosure.

FIG. 3 shows a schematic example of the vacuum cleaner 100 having the cleaner dust cup 108 in the stowed configuration and the dust cup outlet 128 in an open configuration. As shown, a dust cup door 300 may be configured to selectively open and close the dust cup outlet 128, selectively transitioning the dust cup outlet 128 between the open and closed configurations. The dust cup door 300 can be pivotally coupled to the cleaner dust cup 108 such that the dust cup door 300 pivots to selectively open and close the dust cup outlet 128. For example, when the vacuum cleaner 100 is docked with the docking station 102, airflow generated by the station suction motor 122 may cause the dust cup door 300 to pivot, opening the dust cup outlet 128 and allowing debris within the cleaner dust cup 108 to become entrained within the airflow. As such, the dust cup 108 may be generally described as being in an automated emptying configuration when the dust cup outlet 128 is in the open configuration.

Figure 4:
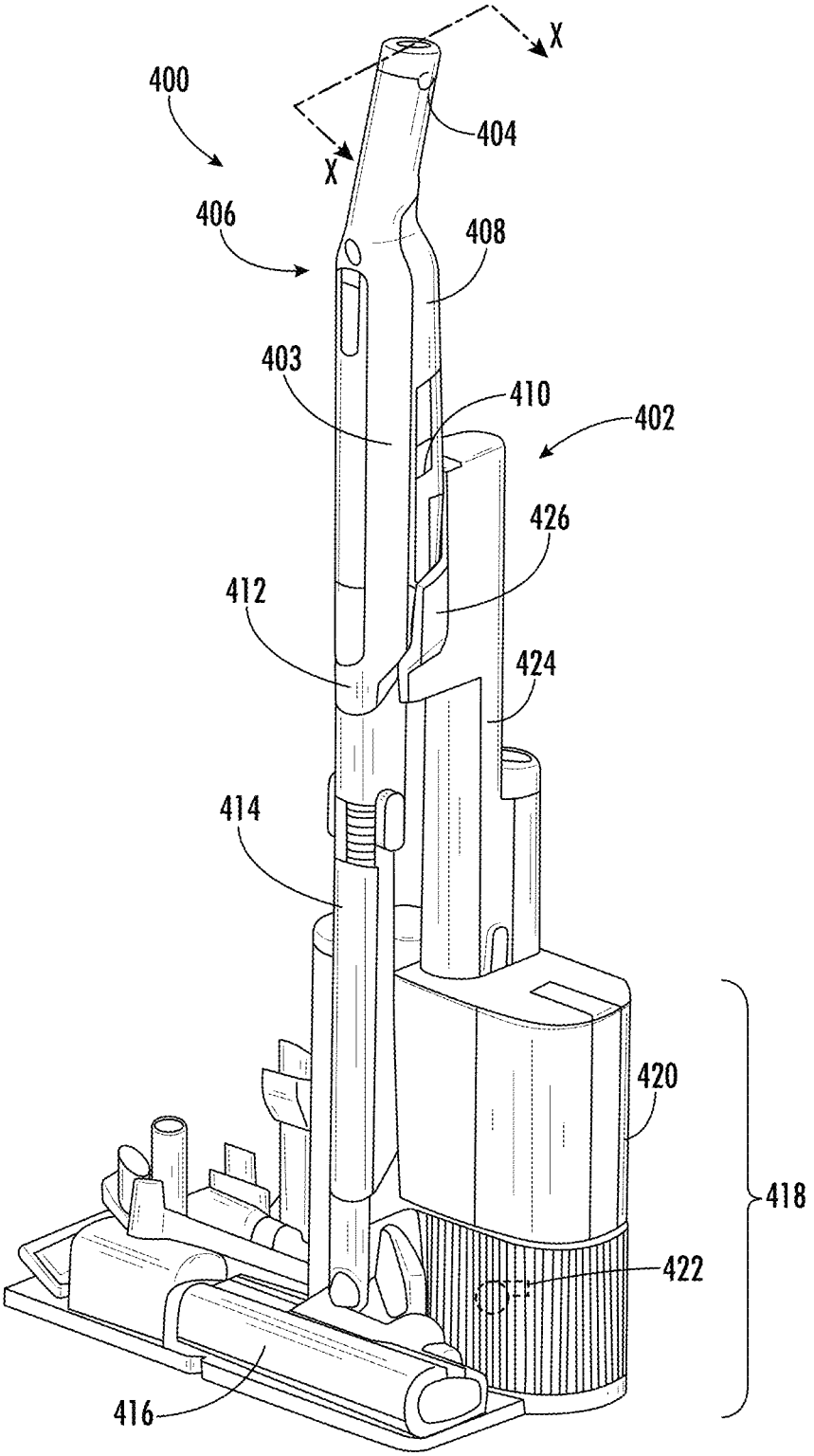
FIG. 4 is a perspective view of a vacuum cleaner docked with a docking station, consistent with embodiments of the present disclosure.

FIG. 4 shows a perspective view of a vacuum cleaner 400, which may be an example of the vacuum cleaner 100 of FIG. 1, and a docking station 402, which may be an example of the docking station 102 of FIG. 1.

The vacuum cleaner 400 includes a body 403, a handle 404, a cleaner user interface 406 proximate the handle 404, a cleaner suction motor 408, a cleaner dust cup 410 pivotally coupled to the body 403, and a cleaner inlet 412, the cleaner suction motor 408 being fluidly coupled to the cleaner dust cup 410 and the cleaner inlet 412. The cleaner inlet 412 may be configured to releasably couple to an accessory 414 (e.g., a cleaning wand). The accessory 414 may be configured to releasably couple to an additional accessory 416 (e.g., a floor nozzle).

The docking station 402 includes a base 418, a station dust cup 420 releasably coupled to the base 418, a station suction motor 422 disposed within the base 418, an up-duct 424 extending from the base 418, and a receptacle 426 coupled to the up-duct 424. The receptacle 426 is configured to receive at least a portion of the vacuum cleaner 400 such that the vacuum cleaner 400 releasably couples (docks) with the docking station 402. The receptacle 426 may also be configured to receive at least a portion of the accessory 414 such that the accessory 414 releasably couples (docks) with the docking station 402.

Figure 5:
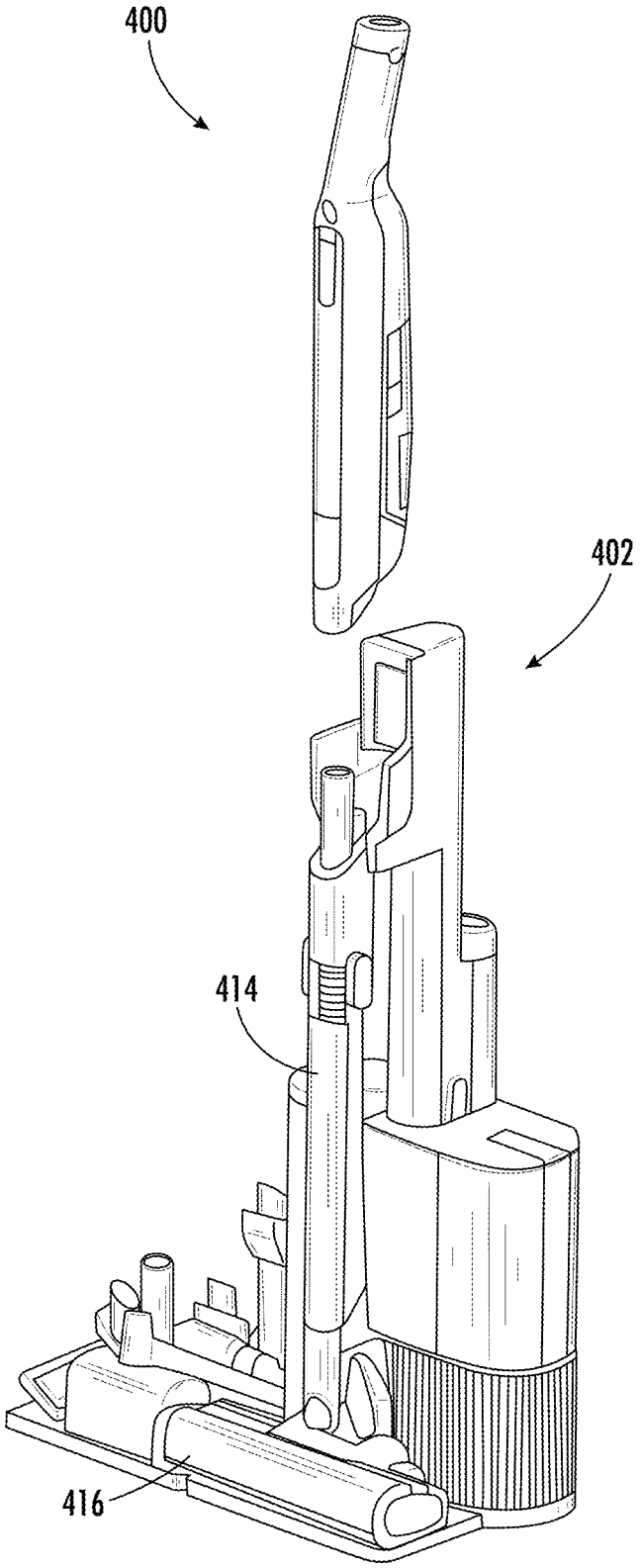
FIG. 5 is a perspective view of the vacuum cleaner of FIG. 4 being undocked from the docking station of FIG. 4, while one or more accessories of the vacuum cleaner remain docked with the docking station, consistent with embodiments of the present disclosure.

FIG. 5 shows a perspective view of the vacuum cleaner 400 and the docking station 402, wherein the vacuum cleaner 400 is undocked from the docking station 402. As shown, the vacuum cleaner 400 may be used independent of the accessories 414 and 416 and the accessories 414 and 416 may remain docked with the docking station 402 separate from the vacuum cleaner 400. When the vacuum cleaner 400 is undocked separately from the accessories 414 and 416, the accessories 414 and 416 may be undocked from the docking station 402 independent of the vacuum cleaner 400. In some instances, when the accessories 414 and 416 are not docked with the docking station 402, the vacuum cleaner 400 may be docked with the docking station 402 separately from the accessories 414 and 416.

Figure 6A:
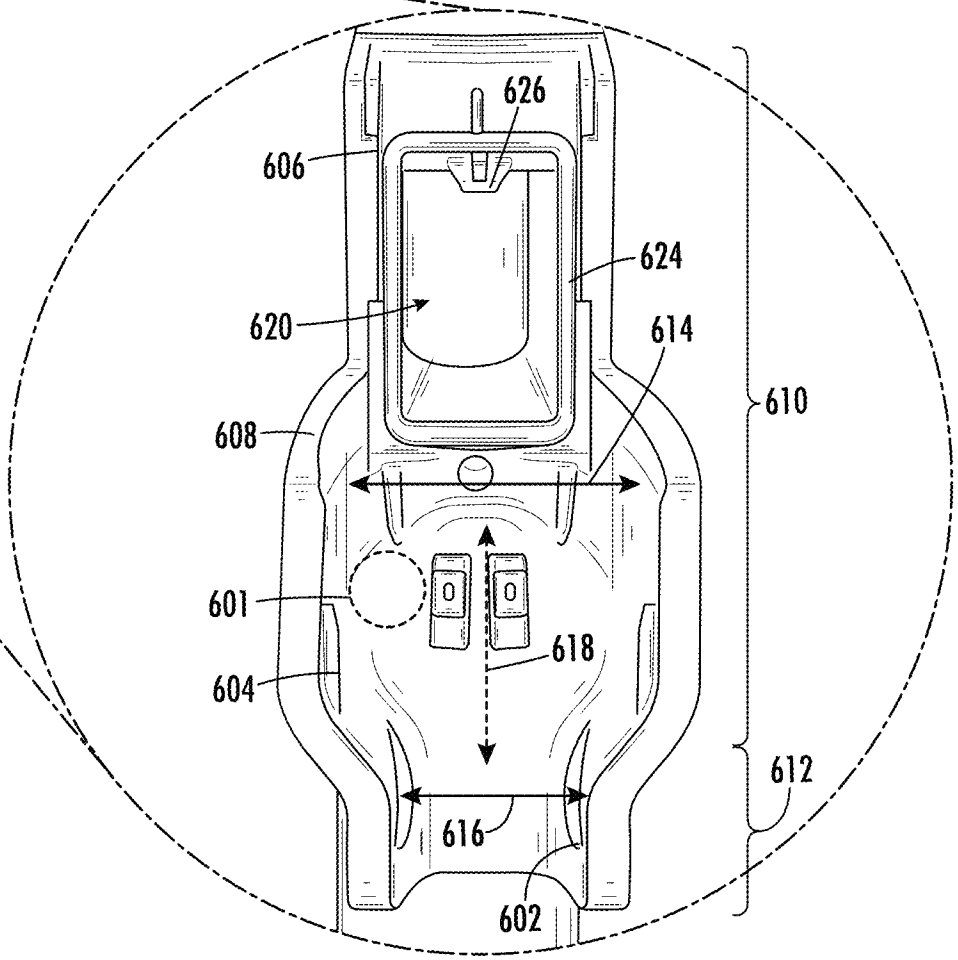
FIG. 6A is a magnified view of a portion of the docking station of FIG. 4 corresponding to region 6A of FIG. 6, consistent with embodiments of the present disclosure.
Figure 6:
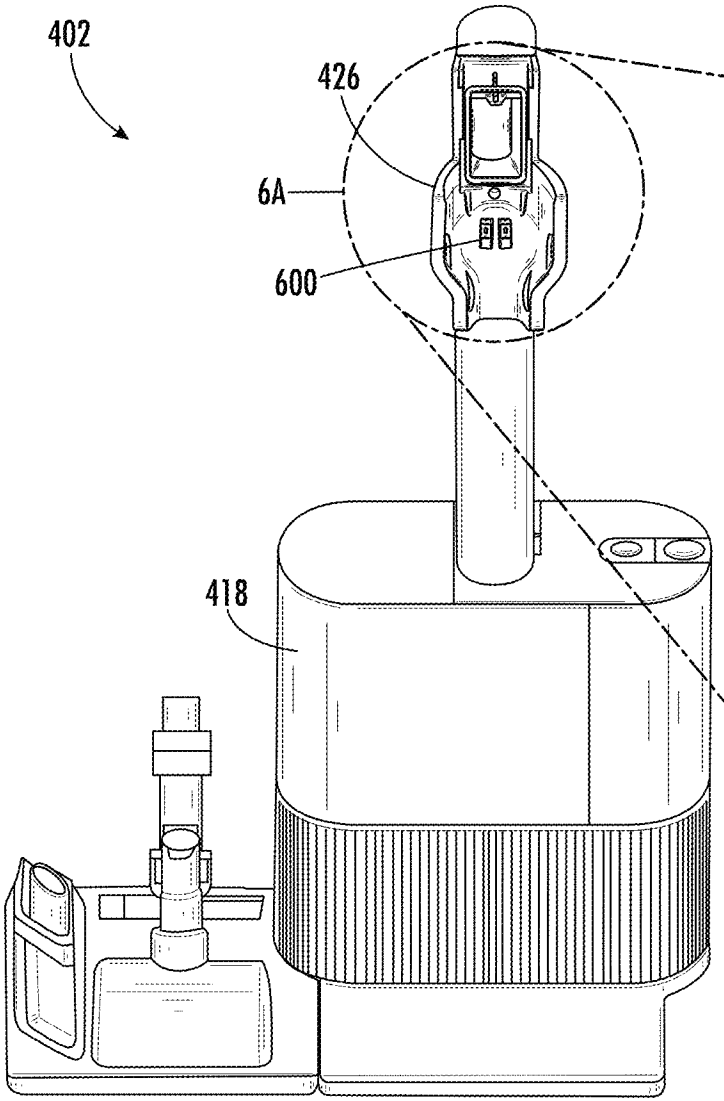
FIG. 6 is a perspective view of the docking station of FIG. 4, consistent with embodiments of the present disclosure

FIG. 6 shows a perspective view of the docking station 402 and FIG. 6A shows a magnified view corresponding to region 6A in FIG. 6. As shown, the receptacle 426 includes charging contacts 600 configured to electrically couple to the vacuum cleaner 400 (e.g., for charging one or more batteries of the vacuum cleaner 400), one or more accessory aligners 602, one or more cleaner aligners 604, and one or more dust cup aligners 606. In some instances, the docking station 402 may be configured to detect that the vacuum cleaner 400 is docked thereto using the charging contacts 600. Additionally, or alternatively, the receptacle 426 may include one or more sensors 601 (e.g., a tactile switch, a hall-effect sensor, and/or any other type of sensor) to detect that the vacuum cleaner 400 is docked thereto. In response to detecting the vacuum cleaner 400 is docked with the docking station 402, the docking station 402 may be caused to carry out an evacuation behavior. In some instances, the docking station 402 may carry out the evacuation behavior in response to detecting that the vacuum cleaner 400 is docked with the docking station 402 and in response to receiving a user input.

As shown, the receptacle 426 is defined by one or more receptacle sidewalls 608 that are shaped to follow a corresponding contour of the vacuum cleaner 400 and/or accessory 414 such that the receptacle 426 may be generally described as including a cleaner region 610 and an accessory region 612. For example, the receptacle 426 may have a first width 614 and a second width 616, wherein the first width 614 is greater than the second width 616. The second width 616 may be closer to the base 418 of the docking station 402 than the first width 614. In some instances, the second width 616 may generally correspond to a width of the accessory 414 (FIG. 4) and the first width 614 may correspond to a width of the vacuum cleaner 400 (FIG. 4). As such, the receptacle 426 may be generally described as being configured to receive at least a portion of the vacuum cleaner 400 and at least a portion of the accessory 414.

The one or more accessory aligners 602 are configured to engage (e.g., contact) the accessory 414 in order to align the accessory 414 relative to the receptacle 426. The one or more accessory aligners 602 may be grooves that are configured to receive a corresponding portion (e.g., an alignment protrusion) of the accessory 414. In some instances, at least a portion of the one or more accessory aligners 602 are configured to restrict movement of the of the accessory 414 to one or more predetermined axes when at least a portion of the accessory 414 is engaging the one or more accessory aligners 602. For example, at least a portion of the one or more accessory aligners 602 may be configured to restrict movement of the accessory 414 to an insertion/removal axis 618 of the receptacle 426 when at least a portion of the accessory 414 is engaging the one or more accessory aligners 602. The insertion/removal axis 618 may extend substantially (e.g., within 1°, 2°, 3°, 4°, or 5° of) parallel to a longitudinal axis of the up-duct 424.

The one or more cleaner aligners 604 are configured to engage (e.g., contact) the body 403 (FIG. 4) of the vacuum cleaner 400 in order to align the vacuum cleaner 400 relative to the receptacle 426. The one or more cleaner aligners 604 may be protrusions that are configured to be received within a corresponding groove in the vacuum cleaner 400 (e.g., in the body 403). In some instances, at least a portion of the one or more cleaner aligners 604 are configured to restrict movement of the vacuum cleaner 400 to one or more axes when at least a portion of the vacuum cleaner 400 engages the one or more cleaner aligners 604. For example, at least a portion of the one or more cleaner aligners 604 may be configured to restrict movement of the vacuum cleaner 400 to the insertion/removal axis 618 when at least a portion of the vacuum cleaner 400 is engaging the one or more cleaner aligners 604.

The one or more dust cup aligners 606 are configured to engage the cleaner dust cup 410 (FIG. 4) in order to align a dust cup outlet with a station inlet 620 of the receptacle 426. As shown, there may be a plurality of dust cup aligners 606 disposed on opposing sides of the station inlet 620. The one or more dust cup aligners 606 may be grooves configured to receive at least a portion of the cleaner dust cup 410. In some instances, at least a portion of the one or more dust cup aligners 606 are configured to restrict movement of the vacuum cleaner 400 to one or more axes when at least a portion of the cleaner dust cup 410 engages the one or more dust cup aligners 606. For example, at least a portion of the one or more dust cup aligners 606 may be configured to restrict movement of the vacuum cleaner 400 to the insertion/removal axis 618 when at least a portion of the cleaner dust cup 410 is engaging the one or more dust cup aligners 606. The dust cup aligners 606 may be further configured to urge the cleaner dust cup 410 into engagement with a seal 624 extending around a perimeter of the station inlet 620. The seal 624 can be resiliently deformable such that, when the vacuum cleaner 400 is received within the receptacle 426, the seal 624 is at least partially compressed. For example, the seal 624 may include thermoplastic polyurethane ("TPU").

Figure 7:
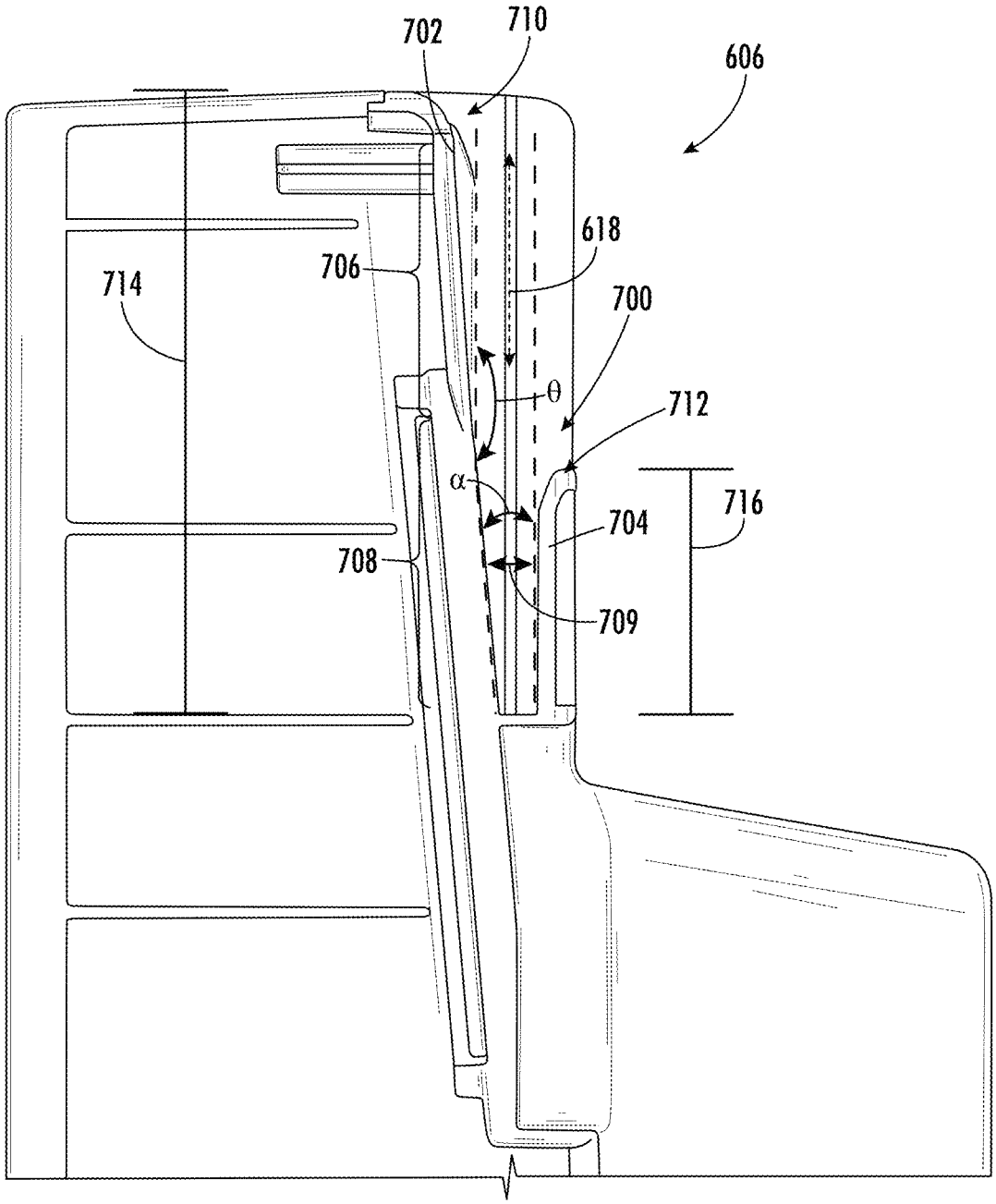
FIG. 7 is cross-sectional view of a receptacle of the docking station of FIG. 4 for receiving the vacuum cleaner of FIG. 4, consistent with embodiments of the present disclosure.

With reference to FIG. 7, which shows a cross-sectional view of a portion of the receptacle 426, the one or more dust cup aligners 606 may include a dust cup aligner groove 700 defined by a first groove sidewall 702 and a second groove sidewall 704. The first and second groove sidewalls 702 may be configured to encourage formation of a seal between the seal 624 (FIG. 6A) and the cleaner dust cup 410 and/or mitigate wear on the seal 624 resulting from repeated docking and undocking of the vacuum cleaner 400 with the docking station 402. The first groove sidewall 702 may include a first sidewall portion 706 and a second sidewall portion 708, the first sidewall portion 706 intersecting the second sidewall portion 708 to form a sidewall portion angle θ. The sidewall portion angle θ may be an obtuse angle that extends between surfaces of the first and second sidewall portions 706 and 708 that face the second groove sidewall 704. The second sidewall portion 708 may form a groove angle α with the second groove sidewall 704 such that a separation distance 709 extending between the second sidewall portion 708 and the second groove sidewall 704 decreases in a direction of the base 418 of the docking station 402. In other words, the dust cup aligner groove 700 may include a tapering region that tapers in a direction of the base 418.

The groove angle α extends from a surface of the second sidewall portion 708 that faces the second groove sidewall 704 to the second groove sidewall 704. The groove angle α may be, for example, in a range of 1° to 20°. By way of further example the groove angle α may be, for example, in a range of 5° to 15°. By way of still further example, the groove angle α may be, for example, about (e.g., within 1%, 2%, 3%, 4,% or 5% of) 10°.

The first and/or second groove sidewall 702 and/or 704 may include a chamfered region 710 and/or 712 configured to encourage insertion of at least a portion of the cleaner dust cup 410 (FIG. 4) into the dust cup aligner groove 700. The first groove sidewall 702 has a first sidewall height 714 and the second groove sidewall 704 has a second sidewall height 716. The first sidewall height 714 may be greater than the second sidewall height 716. As such, movement of the vacuum cleaner 400 along the insertion/removal axis 618 may be restrained for only a portion of the dust cup aligner groove 700 (e.g., the portion of the dust cup aligner groove 700 extending between the first and second groove sidewalls 702 and 704).

Figure 8:
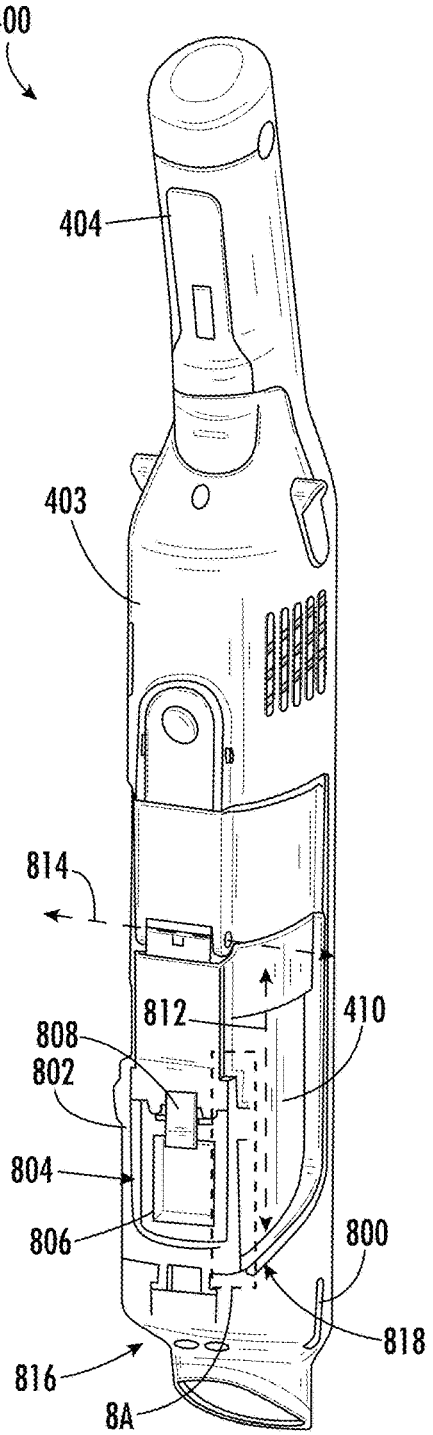
FIG. 8 is a perspective view of the vacuum cleaner of FIG. 4 having a dust cup outlet in a closed configuration, consistent with embodiments of the present disclosure.
Figure 9:
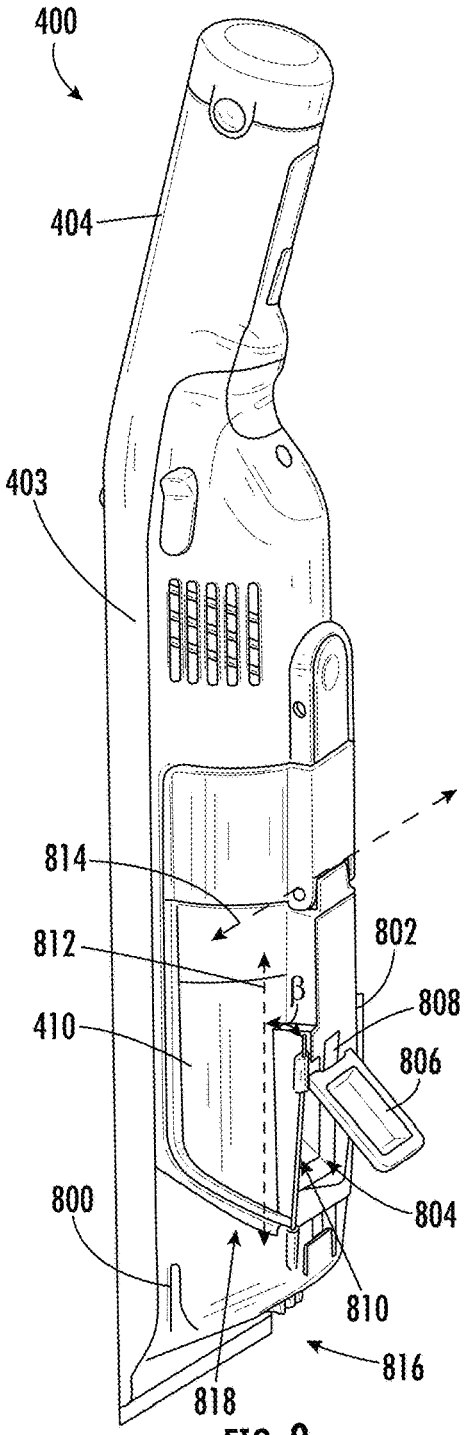
FIG. 9 is a perspective view of the vacuum cleaner of FIG. 4 having the dust cup outlet in an open configuration, consistent with embodiments of the present disclosure.

FIGS. 8 and 9 show perspective views of the vacuum cleaner 400. As shown, the body 403 of the vacuum cleaner 400 includes one or more cleaner alignment grooves 800 configured to cooperate with the docking station 402 (e.g., the one or more cleaner aligners 604 (FIG. 6A) of the receptacle 426) and the cleaner dust cup 410 includes a dust cup alignment protrusion 802 configured to cooperate with the docking station 402 (e.g., the dust cup aligners 606 (FIG. 6A)). The dust cup alignment protrusion 802 may include a dust cup outlet 804 that is configured to be selectively opened and closed by a dust cup door 806 such that debris within the cleaner dust cup 410 may selectively pass therethrough.

As shown, the dust cup door 806 is configured to transition between a closed position (FIG. 8) and an open position (FIG. 9). For example, the dust cup door 806 can be pivotally coupled to the cleaner dust cup 410 (e.g., the dust cup alignment protrusion 802) such that the dust cup door 806 pivots between the open and closed positions. The dust cup door 806 may be biased (e.g., using a spring such as a torsion spring) towards the closed position. When the dust cup door 806 is in the open position, the cleaner dust cup 410 may generally be described as being in an automated emptying configuration.

The vacuum cleaner 400 (e.g., the cleaner dust cup 410) may include a retainer 808. The retainer 808 may be moveably (e.g., slidably) coupled to the dust cup alignment protrusion 802, wherein the retainer 808 is configured to transition between a locked position (FIG. 8) and an unlocked position (FIG. 9). When the retainer 808 is in the locked position, the dust cup door 806 is prevented from moving from the closed position to the open position (e.g., pivotal movement of the dust cup door 806 may be substantially prevented). When the retainer 808 is in the unlocked position, the dust cup door 806 is capable of moving from the closed position to the open position. The retainer 808 may be biased (e.g., using a spring such as a compression spring) towards the locked position.

The retainer 808 may be transitioned from the locked position to the unlocked position when the vacuum cleaner 400 is being docked with the docking station 402. For example, the receptacle 426 may include an actuation protrusion 626 (FIG. 6A) that extends transverse to (e.g., perpendicular to) the insertion/removal axis 618. The actuation protrusion 626 is configured to engage (e.g., contact) the retainer 808 when the vacuum cleaner 400 is being received by the receptacle 426. Engagement of the actuation protrusion 626 with the retainer 808 causes the retainer to transition (e.g., slide) from the locked position to the unlocked position when the vacuum cleaner 400 is docked with the docking station 402.

The dust cup alignment protrusion 802 is configured to cooperate with the dust cup aligners 606. For example, the dust cup alignment protrusion 802 may have a shape (e.g., a wedged shape) that generally corresponds to the shape of the dust cup aligner groove 700 (FIG. 7). For example, the shape of the dust cup alignment protrusion 802 may be such that second groove sidewall 704 engages (e.g., contacts) the dust cup alignment protrusion 802, urging the dust cup alignment protrusion 802 into engagement (e.g., contact) with the seal 624 (FIG. 6A). Engagement between the seal 624 and the dust cup alignment protrusion 802 may at least partially compress the seal 624. For example, a seal engaging surface 810 of the dust cup alignment protrusion 802 may come into engagement with the seal 624 forming an at least partial seal. Formation of a partial seal may mitigate debris pluming when the cleaner dust cup 410 is being emptied.

Figure 8A:
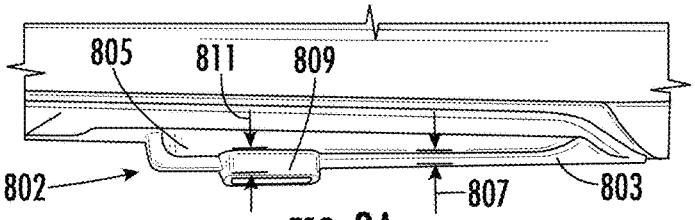
FIG. 8A is a magnified view of a portion of the vacuum cleaner of FIG. 4 corresponding to region 8A of FIG. 8, consistent with embodiments of the present disclosure.

In some instances, and with additional reference to FIG. 8A (which is magnified view generally corresponding to region 8A in FIG. 8), the dust cup alignment protrusion 802 may further include an alignment lip 803 that extends outwardly from a protrusion sidewall 805 of the dust cup alignment protrusion 802 by a first extension distance 807. The dust cup alignment protrusion 802 may include a plurality of alignment lips 803, wherein each alignment lip 803 extends along opposing longitudinal sides of the dust cup alignment protrusion 802. The alignment lip 803 may be configured to engage at least a portion of the dust cup aligners 606. In some instances, the alignment lip 803 may include at least a portion of the seal engaging surface 810 of the dust cup alignment protrusion 802. The dust cup alignment protrusion 802 may include (in addition to or in the alternative to the alignment lip 803) an alignment projection 809. The alignment projection 809 may extend from the protrusion sidewall 805 by a second extension distance 811, the second extension distance 811 being greater than the first extension distance 807. The alignment projection 809 may be configured to engage at least a portion of the dust cup aligners 606. In some instances, the alignment projection 809 may include at least a portion of the seal engaging surface 810 of the dust cup alignment protrusion 802.

As shown, the seal engaging surface 810 of the dust cup alignment protrusion 802 forms a protrusion angle β with a cleaner longitudinal axis 812. The protrusion angle β may generally correspond to the groove angle α (FIG. 7). The protrusion angle β may be, for example, in a range of 1° to 20°. By way of further example the protrusion angle β may be, for example, in a range of 5° to 15°. By way of still further example, the protrusion angle β may be, for example, about (e.g., within 1%, 2%, 3%, 4,% or 5% of) 10°.

The cleaner dust cup 410 is pivotally coupled to the body 403 of the vacuum cleaner 400 about a dust cup pivot axis 814. The cleaner dust cup 410 is configured to pivot about the dust cup pivot axis 814 from a stowed configuration to a manual emptying configuration. As shown, when in the stowed configuration, the cleaner dust cup 410 extends along the cleaner longitudinal axis 812 between an inlet end 816 of the body 403 and the handle 404. When the cleaner dust cup 410 pivots to the manual emptying position, an open end 818 of the cleaner dust cup 410 is exposed. As shown, the open end 818 is received within the body 403 when the cleaner dust cup 410 is in the stowed configuration. As such, the cleaner dust cup 410 may generally be described as being configured to pivot such that the open end 818 is selectively received within the body 403. The open end 818 and the dust cup outlet 804 can be on different sides of the cleaner dust cup 410.

Figure 10:
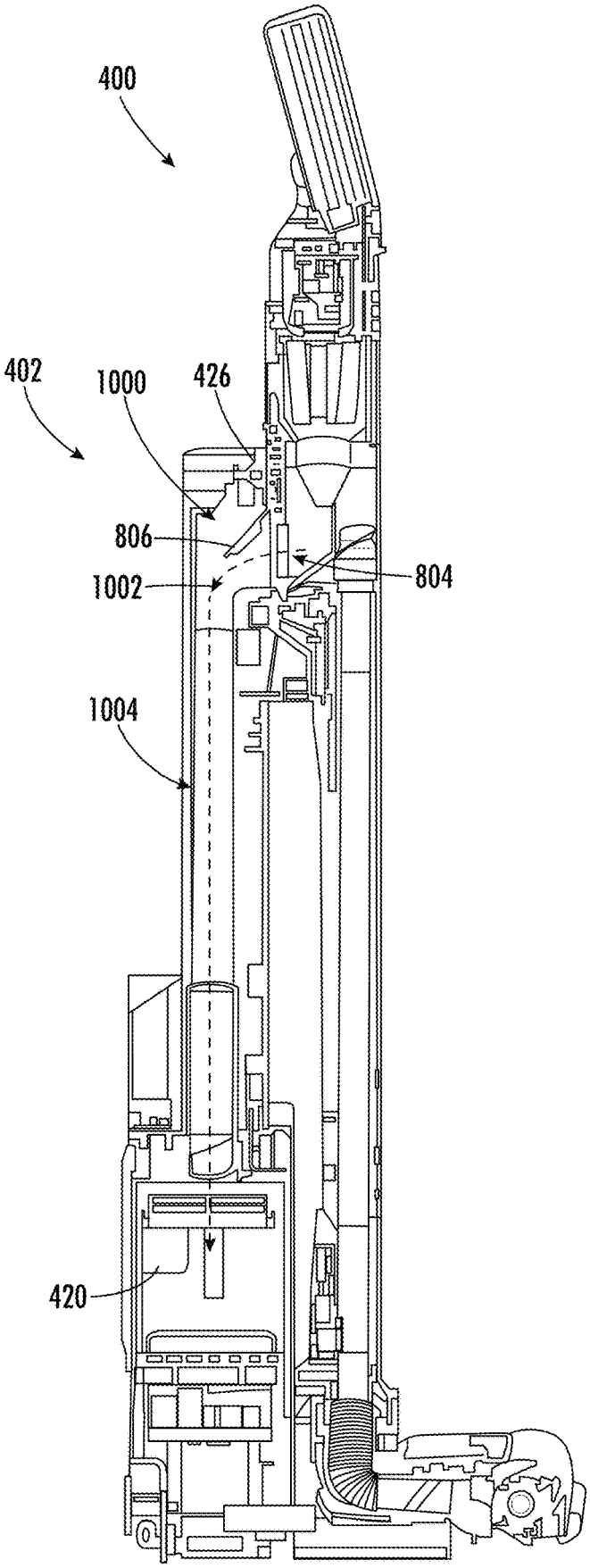
FIG. 10 is a cross-sectional view of the vacuum cleaner and the docking station of FIG. 4 taken along the line X-X of FIG. 4, consistent with embodiments of the present disclosure.

FIG. 10 shows a cross-sectional view of the vacuum cleaner 400 docked with the docking station 402 of FIG. 4 taken along the line X-X of FIG. 4. As shown, the dust cup door 806 is in the open position. The dust cup door 806 can be transitioned from the closed position to the open position in response to the station suction motor 422 (FIG. 4) being activated. For example, the airflow generated by the station suction motor 422 may urge the dust cup door 806 towards the open position. When the station suction motor 422 is deactivated, the dust cup door 806 may transition to the closed position (e.g., as a result of gravity and/or a biasing force). When the dust cup door 806 is in the open position, at least a portion of the dust cup door 806 passes through the station inlet 620 and is at least partially received within a receptacle cavity 1000 of the receptacle 426. In other words, when the dust cup outlet 804 is open, at least a portion of the dust cup door 806 is received within the receptacle cavity 1000.

The airflow generated by the station suction motor 422 may flow along an evacuation flow path 1002. As shown, the evacuation flow path 1002 extends from the cleaner dust cup 410 into the receptacle cavity 1000 through an air channel 1004 of the up-duct 424 and into the station dust cup 420.

An example of a vacuum cleaner, consistent with the present disclosure, may include a body and a dust cup coupled to the body. The dust cup may include an open end that is configured to be selectively received within the body and a dust cup outlet that is configured to be selectively opened and closed.

In some instances, the dust cup may further include a dust cup door configured to selectively open and close the dust cup outlet. In some instances, the dust cup door may be pivotally coupled to the dust cup. In some instances, the dust cup further may further include a retainer configured to transition between a locked position and an unlocked position, wherein pivotal movement of the dust cup door is substantially prevented when the retainer is in the locked position. In some instances, the retainer may be biased towards the locked position. In some instances, the dust cup may further include a dust cup alignment protrusion configured to cooperate with a docking station, the dust cup alignment protrusion including the dust cup outlet. In some instances, the body may include an alignment groove configured to cooperate with a docking station. In some instances, the dust cup outlet and the open end may be on different sides of the dust cup.

An example of a cleaning system, consistent with the present disclosure, may include a vacuum cleaner having a body and a cleaner dust cup coupled to the body and a docking station, the vacuum cleaner configured to dock with the docking station. The cleaner dust cup may include an open end that is configured to be selectively received within the body and a dust cup outlet that is configured to be selectively opened and closed, the dust cup outlet and the open end being on different sides of the cleaner dust cup. The docking station may include a base having a suction motor and a station dust cup, an up-duct extending from the base, and a receptacle having a station inlet, the receptacle being configured to receive at least a portion of the vacuum cleaner, the up-duct fluidly couples the station inlet to the suction motor and the station dust cup.

In some instances, the station inlet may be configured to fluidly couple with the dust cup outlet when the vacuum cleaner is docked with the docking station. In some instances, the cleaner dust cup may further include a dust cup door configured to selectively open and close the dust cup outlet. In some instances, the receptacle may include a receptacle cavity, the receptacle cavity being configured to receive at least a portion of the dust cup door when the dust cup outlet is open. In some instances, the dust cup door may be configured to pivot to selectively open and close the dust cup outlet and an airflow generated by the suction motor pivots the dust cup door to open the dust cup outlet. In some instances, the cleaner dust cup may further include a retainer configured to transition between a locked position and an unlocked position, wherein movement of the dust cup door is substantially prevented when the retainer is in the locked position. In some instances, the receptacle may include an actuation protrusion configured to transition the retainer from the locked position to the unlocked position when the vacuum cleaner is docked with the docking station. In some instances, the actuation protrusion may extend transverse to an insertion/removal axis of the receptacle. In some instances, the retainer may be biased towards the locked position. In some instances, the receptacle may include a dust cup aligner configured to align the dust cup outlet with the station inlet. In some instances, the dust cup aligner may include a groove, the groove including a tapering region that tapers in a direction of the base. In some instances, the receptacle may include a cleaner aligner. In some instances, the vacuum cleaner may include an alignment groove configured to cooperate with the cleaner aligner. In some instances, the dust cup may be pivotally coupled to the body While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

a body; and a dust cup to collect debris and coupled to the body and configured to pivot about a dust cup pivot axis in a first direction, the dust cup is further configured to be selectively transitioned between a manual emptying configuration and an automated emptying configuration, the dust cup including:

an open end that is configured to be selectively received within the body;

a dust cup outlet that is configured to be selectively opened and closed, wherein the open end and the dust cup outlet are separate openings for emptying the debris; and a dust cup door configured to pivot about a door pivot axis to selectively open and close the dust cup outlet, the dust cup door being configured to pivot in the first direction when the open end is received within the body, wherein:

when transitioned to the manual emptying configuration, the dust cup pivots about the dust cup pivot axis in the first direction to expose the open end to empty the debris from the open end; and when transitioned to the automated emptying configuration, the dust cup door pivots about the door pivot axis in the first direction to expose the dust cup outlet to allow the debris to be suctioned from the dust cup outlet.

2. The vacuum cleaner of claim 1, wherein the dust cup further includes a retainer configured to transition between a locked position and an unlocked position, wherein pivotal movement of the dust cup door is substantially prevented when the retainer is in the locked position.

3. The vacuum cleaner of claim 1, wherein the dust cup outlet and the open end are on different sides of the dust cup.

4. The vacuum cleaner of claim 1, wherein the dust cup further includes a dust cup alignment protrusion configured to cooperate with a docking station, the dust cup alignment protrusion including the dust cup outlet.

5. The vacuum cleaner of claim 1, wherein the body includes an alignment groove configured to cooperate with a docking station.

6. The vacuum cleaner of claim 1, wherein the dust cup pivot axis and the open end of the dust cup are disposed at opposing ends of the dust cup.

7. A cleaning system comprising:

a vacuum cleaner having a body and a cleaner dust cup to collect debris and coupled to the body, the cleaner dust cup configured to pivot about a dust cup pivot axis in a first direction, the dust cup is further configured to be selectively transitioned between a manual emptying configuration and an automated emptying configuration, the cleaner dust cup including:

an open end that is configured to be selectively received within the body;

a dust cup outlet that is configured to be selectively opened and closed, the dust cup outlet and the open end being on different sides of the cleaner dust cup; and a dust cup door configured to pivot about a door pivot axis to selectively open and close the dust cup outlet, the dust cup door being configured to pivot in the first direction when the open end is received within the body, wherein:

when transitioned to the manual emptying configuration, the dust cup pivots about the dust cup pivot axis in the first direction to expose the open end to empty the debris from the open end; and when transitioned to the automated emptying configuration, the dust cup door pivots about the door pivot axis in the first direction to expose the dust cup outlet to allow the debris to be suctioned from the dust cup outlet; and a docking station, the vacuum cleaner configured to dock with the docking station, the docking station including:

a base having a suction motor and a station dust cup;

an up-duct extending from the base; and a receptacle having a station inlet, the receptacle being configured to receive at least a portion of the vacuum cleaner, the up-duct fluidly couples the station inlet to the suction motor and the station dust cup.

8. The cleaning system of claim 7, wherein the station inlet is configured to fluidly couple with the dust cup outlet when the vacuum cleaner is docked with the docking station.

9. The cleaning system of claim 8, wherein the receptacle includes a receptacle cavity, the receptacle cavity being configured to receive at least a portion of the dust cup door when the dust cup outlet is open.

10. The cleaning system of claim 8, wherein the cleaner dust cup further includes a retainer configured to transition between a locked position and an unlocked position, wherein movement of the dust cup door is substantially prevented when the retainer is in the locked position.

11. The cleaning system of claim 10, wherein the receptacle includes an actuation protrusion configured to transition the retainer from the locked position to the unlocked position when the vacuum cleaner is docked with the docking station.

12. The cleaning system of claim 11, wherein the actuation protrusion extends transverse to an insertion/removal axis of the receptacle.

13. The cleaning system of claim 7, wherein an airflow generated by the suction motor pivots the dust cup door to open the dust cup outlet.

14. The cleaning system of claim 7, wherein the dust cup is pivotally coupled to the body.

15. The cleaning system of claim 7, wherein the receptacle includes a dust cup aligner configured to align the dust cup outlet with the station inlet.

16. The cleaning system of claim 15, wherein the dust cup aligner includes a groove, the groove including a tapering region that tapers in a direction of the base.

17. The cleaning system of claim 15, wherein the receptacle includes a cleaner aligner.

18. The cleaning system of claim 17, wherein the vacuum cleaner includes an alignment groove configured to cooperate with the cleaner aligner.

19. The cleaning system of claim 7, wherein the dust cup pivot axis and the open end of the dust cup are disposed at opposing ends of the dust cup.

20. The cleaning system of claim 7, wherein the up-duct extends vertically along a longitudinal axis and the receptacle is configured to encourage the vacuum cleaner to move along an insertion axis to fluidly couple the dust cup outlet to the station inlet, the insertion axis being substantially parallel to the longitudinal axis.

* * * * *